United States Patent [19]

Platt

[11] 4,379,189

[45] Apr. 5, 1983

[54] NONWOVEN TEXTILE FABRIC WITH FUSED FACE AND RAISED LOOP PILE

[75] Inventor: Louis Platt, Seneca, S.C.

[73] Assignee: Phillips Petroleum Company, Bartlesville, Okla.

[21] Appl. No.: 218,142

[22] Filed: Dec. 19, 1980

[51] Int. Cl.[3] ..... D04H 18/00

[52] U.S. Cl. ..... 428/89; 28/107; 28/109; 28/111; 156/72; 428/91; 428/92; 428/300; 428/301

[58] Field of Search ..... 428/300, 301, 89, 91, 428/92; 156/72, 148; 28/107, 109, 111; 26/2 R

[56] References Cited

U.S. PATENT DOCUMENTS

| | | | |
|---|---|---|---|
| 3,022,813 | 2/1962 | Glover | 156/148 |
| 3,312,584 | 4/1967 | Charlton et al. | 161/81 |
| 3,530,557 | 9/1970 | Dilo | 28/4 |
| 3,607,503 | 9/1971 | Parlin et al. | 156/148 |
| 3,681,823 | 8/1972 | Dilo | 28/4 R |
| 3,729,785 | 5/1973 | Sommer | 28/4 R |
| 3,822,173 | 6/1974 | Graber et al. | 161/62 |
| 3,829,939 | 8/1974 | Dilo | 28/4 R |
| 3,909,891 | 10/1975 | Dilo | 28/4 R |
| 3,952,121 | 4/1976 | Dilo | 428/36 |
| 4,042,655 | 8/1977 | Platt | 264/25 |
| 4,197,343 | 1/1980 | Forsythe | 428/195 |

FOREIGN PATENT DOCUMENTS 1544900 12/1968 France .

*Primary Examiner*—Marion McCamish

[57] ABSTRACT

A nonwoven textile fabric comprising a batt of nonwoven filaments and having at least a portion of the filaments extending outwardly from one face of the batt to form a raised pile. In one embodiment at least a portion of the filaments are fused together on one side of the batt forming a fused face, and the raised pile extends outwardly from the fused face. In another embodiment, the batt has a fused face on each side thereof and the raised pile extends outwardly from one of these fused faces. In still another embodiment, the batt has a single fused face and the raised pile extends outwardly from the side of the batt opposite the fused face. The textile fabrics are also disclosed with an adhesive and/or a backcoating layer on the side opposite the raised pile. Method and apparatus for the production of the nonwoven textile fabrics are also disclosed which employ needle punching the nonwoven batt with forked needles to provide the raised pile.

46 Claims, 24 Drawing Figures

NONWOVEN TEXTILE FABRIC WITH FUSED FACE AND RAISED LOOP PILE

The invention relates to nonwoven fabric. In one aspect the invention relates to a nonwoven textile fabric. In another aspect the invention relates to a method of producing a nonwoven textile fabric.

In the past thirty years or so development of polymeric materials has experienced tremendous growth. One of the more significant areas in which polymeric materials have been used is in the textile industry. The melt spinning of thermosplastic synthetic polymeric materials to produce continuous filaments, discontinuous or staple filaments, and yarns of such materials has revolutionized the textile industry.

Although much of the growth in the use of synthetic filaments has been in the production of knitted or woven fabrics, the production of nonwoven fabrics or materials from synthetic filaments has also been characterized by substantial growth. There are a number of methods known today for producing nonwoven fabrics from synthetic filaments, both continuous and discontinuous or staple filaments, and mixtures of natural and synthetic filaments. A particularly significant method for the production of nonwoven fabric is disclosed in U.S. Pat. No. 4,042,655 issued to Platt et al and assigned to Phillips Petroleum Company.

Nonwoven fabrics find a variety of uses. Among these uses is the use of nonwoven fabrics in the manufacture of carpets, particularly in the primary and/or secondary backing material of such carpets. Since nonwoven fabrics made of synthetic fibers resist deterioration caused by mildew much better than jute, the material generally used for carpet backing, carpets made using synthetic nonwoven fabrics as the backing material are excellent carpets for use in areas exposed to moisture, such as bathrooms, kitchens, patios and other outdoor areas. In addition, nonwoven fabrics, both fused and unfused, are used as substitutes in the production of various laminates, and as ticking material in the furniture industry. Although nonwoven textile fabrics are useful in a variety of applications, as indicated above, potential uses of nonwoven fabrics are essentially unlimited.

The present invention contemplates a textile fabric comprising a batt of nonwoven filaments, with the batt having a first side and a second side. The first side has a first fused face wherein at least a portion of the filaments on the first side are fused together. A plurality of unfused filaments extend through the first fused face from between the second side and the first fused face to thereby form a raised pile on the first side extending outwardly from the first fused face.

The invention further contemplates a method of producing a nonwoven fabric comprising the steps of forming a batt comprising nonwoven fibers, drafting the thus formed batt in at least one direction, fusing at least a portion of the fibers on one side of the thus drafted batt to form a fused face on the one side of the batt and an unfused face on the opposite side of the batt, and needle punching the thus fused batt so that at least a portion of the fibers from the unfused face are punched from the opposite side of the batt through the fused face to form a raised pile on the one side of the batt.

An object of the invention is to provide an improved nonwoven fabric.

Another object of the invention is to provide a decorative nonwoven fabric having improved strength and dimensional stability.

A further object of the invention is to provide a decorative nonwoven fabric having exceptionally soft hand.

A still further object of the invention is to provide a decorative nonwoven fabric having exceptionally good drape.

Yet another object of the invention is to provide an economical decorative nonwoven fabric.

Still another object of the invention is to provide an economical method of producing a nonwoven fabric.

Other objects and advantages of the invention will be evidenced from the following detailed description when read in conjunction with the accompanying drawings in which:

FIGS. 1A and 1B provide a top view of a schematic representation of an embodiment of apparatus suitable for use in producing the nonwoven fabric of the invention;

FIGS. 2A and 2B provide an elevation view of the apparatus of FIGS. 1A and 1B;

Figure 1A:
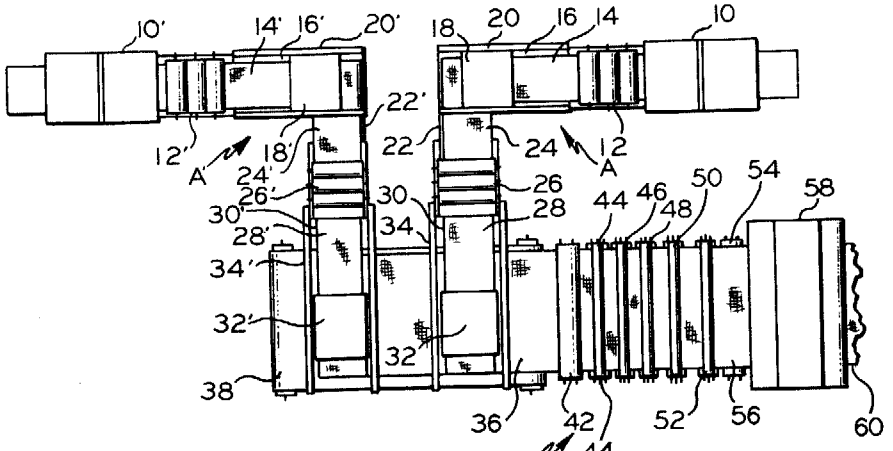

Referring now to FIGS. 1A and 1B and FIGS. 2A and 2B, there is therein shown a portion of apparatus suitable for the production of a nonwoven textile fabric in accordance with the invention. The apparatus of FIGS. 1A, 1B, 2A and 2B includes batt-forming means comprising two web-forming trains A and A' in which feed means 10, 10' such as bale breakers, blender boxes, feed boxes, etc., feed filaments in the form of discontinuous or staple fibers, such as polypropylene staple fibers, to breaker carding machines 12, 12'. The carding machines 12, 12' produce carded webs 14, 14' of fibers which are picked up by the takeoff aprons 16, 16' of crosslappers 20, 20'. Crosslappers 20, 20' also comprise lapper aprons 18, 18' which traverse carrier means, such as intermediate aprons 22, 22', in a reciprocating motion laying the webs 14, 14' to form intermediate batts 24, 24' on the intermediate aprons 22, 22'. The intermediate batts 24, 24' are passed to finisher carding machines 26, 26' by intermediate aprons 22, 22'. The carding machines 26, 26' produce carded webs 28, 28' which are picked up by takeup aprons 30, 30' of crosslappers 34, 34'. The crosslappers 34, 34' also comprise lapper aprons 32, 32' which form a batt of fibers 36 as the lapper aprons 32, 32' traverse a floor apron 38.

The carded webs 28, 28' are laid on the floor apron 38 to build up several thicknesses of the webs to produce the batt 36. Only means for forming a batt with the fibers oriented primarily in the transverse direction, that is the direction normal to the machine direction, is essential to practice the invention, and such means can be provided by any suitable apparatus. As an example, only one feed means, carding machine, and crosslapper are actually needed to form a batt. The use of two carding machines such as a breaker carding machine and a finisher carding machine and associated aprons and crosslappers are not essential to practice the invention. The use of two carding machines tends to open up the fibers better to form a more uniform web and to provide some randomization of the discontinuous or staple fibers forming the webs which form the batt; however, the fibers of the batt 36 are still primarily oriented in the transverse direction. Two web-forming trains A and A', or more, are used to increase the speed of the overall operation, and thus are optional.

As used throughout the specification, the term "transverse direction" means that direction transverse to the direction of movement of the batt on the floor apron 38, which latter direction is termed the "machine direction." Accordingly, the term "machine direction" means the direction parallel to the direction the batt 36 moves on the floor apron 38.

Figure 2A:
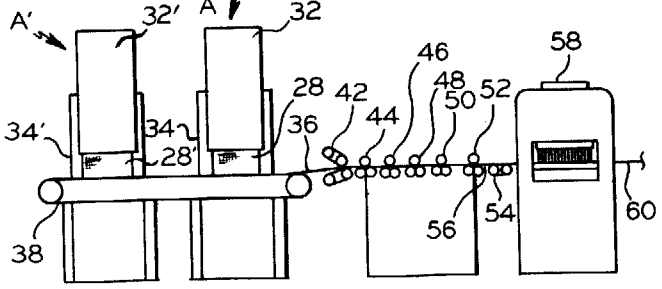

First batt-drafting means 40, comprising at least two sets of nip rolls or an inlet or feed apron 42 and one set of nip rolls 44, is used to draft the batt 36 in the machine direction. As used herein the terms stretching, drawing and drafting are synonymous. In FIGS. 1A and 2A the first batt-drafting means 40 comprises five sets of nip rolls 44, 46, 48, 50 and 52 and inlet apron 42 and outlet apron 54. Each set of nip rolls is shown as a one-over-two configuration, which works very well, but almost any arrangement can be used, such as a one-over-one, two-over-one, etc., as well as mixtures of nip roll configurations.

The batt 56, thus drafted in the machine direction, is then passed to a needle loom 58 wherein the batt is needle punched at a density in the range of 100 to 1000 punches per square inch and at a penetration in the range of from about ¼ inch to about ¾ inch. One or more needle looms can be used. The needle looms can be either of the single needle board type or the double needle board type.

Figure 1B:
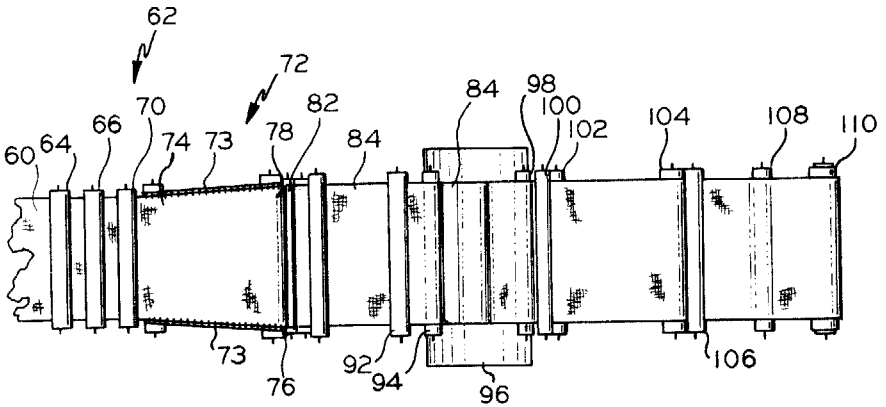
Figure 2B:
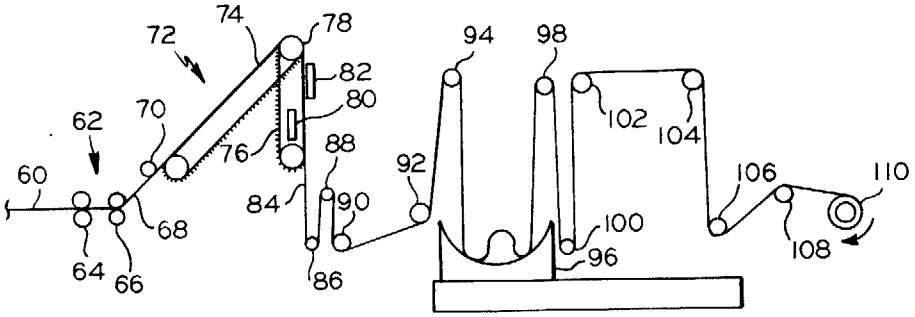

The drafted and needled batt 60 is again drafted in the machine direction, as shown in FIGS. 1B and 2B, by second drafting means 62 comprising at least two sets of nip rolls 64 and 66 or an inlet apron and one set of nip rolls (not shown). The needled batt 68 which was drafted in the machine direction both before and after needle punching in the needle loom 58 is passed over roll 70 to transverse drafting means, such as a tenter frame 72 having diverging tracks 73. As shown in FIGS. 1B and 2B, the tenter frame 72 comprises a transverse direction drafting section 74, and a tensioning section 76. The tensioning section 76 is not used to draft the batt, but is rather used to subject the batt to tension in the transverse direction.

The transversely drafted batt can be fused using infrared radiation while the batt is subjected to tension in the transverse direction. Infrared heaters 80 and 82 are shown in FIG. 2B positioned adjacent and on opposite sides of the unfused fabric 78. While either or both heaters can be used in fusing a nonwoven fabric depending on the fusion desired, only one of the heaters is employed at any one time in the practice of the instant method of production of the nonwoven textile fabric of the instant invention.

It should also be understood that a fused fabric can be produced in accordance with the invention by employing various other fusion means, such as hot rolls. It will be understood, however, that if hot rolls are employed, the hot rolls are to be applied to one side only of the nonwoven textile fabric in accordance with the instant invention. Although other means can be used, it is preferred to fuse the fabric using infrared radiation because the depth of fusion can be readily controlled and the integrity of the cross-section of the fibers can be maintained.

The fused fabric 84 is normally passed to suitable surge means such as a "J" box 96 and rolls, 86, 88, 90, 92 and 94. From the surge means the fabric is passed to windup means 110 over a plurality of rolls, e.g., surge and idler rolls, 98, 100, 102, 104, 106 and 108.

As shown in the drawing, synthetic filaments of normally solid thermoplastic polymeric material in the form of discontinuous or staple fibers are passed to carding machines 12, 12' to produce carded webs 14, 14'. The carded webs 14, 14' are pickup by takeoff aprons 16, 16' of crosslappers 20, 20'. Lapper aprons 18, 18' lay the carded webs on intermediate aprons 22, 22' to produce an intermediate batt 24, 24' which is passed to carding machines 26, 26' to produce carded webs 28, 28'. The carded webs 28, 28' are picked up by takeoff aprons 30, 30' of crosslappers 34, 34' and these carded web 28, 28' are laid on floor apron 38 by lapper aprons 32, 32' to produce the batt 36. The number of webs used to form the batt 36 depends on a number of variables, such as the desired weight of the batt, the weight of the webs, the amount the batt is to be drafted during the process, etc.

The batt 36 is then drafted in the machine direction by suitable means, such as the five sets of nip rolls 44, 46, 48, 50 and 52. When using nip rolls to practice the invention, only two sets of nip rolls actually are required to draft the batt; however, the use of more than two sets of nip rolls, such as the five nip rolls shown, provides for more uniform drafting since between any set of nip rolls a smaller drafting ratio can be used and still obtain the overall desired drafting ratio. In addition, the batt is frequently drafted between the nip formed by the inlet apron 42 and the first set of nip rolls 44. The batt 36 is drafted because each set of nip rolls is operated at a successively higher speed than the speed of the preceding inlet apron or set of nip rolls. Generally it has been found that utilization of more sets of nip rolls and smaller draft ratios between sets of nip rolls produces a more uniform fabric than is produced when fewer sets of nip rolls are employed with higher draft ratios; however, at some point additional sets of nip rolls with reduced draft ratios between each set of nip rolls will not improve the product.

In addition, there is a maximum speed at which the batt, at a given weight, can be produced due to the limitations of the batt-forming equipment. Thus, as in almost any process, the most economical operation requires consideration of a number of variables, and in particular the various parameters of the material processed. For example, some the variables of the process material which affect the drafting process are the composition of the staple polymer, staple length and denier, staple finish, degree of crimp in the staple fibers, weight of the batt, etc. Generally from about two to about six sets of nip roll are utilized with an overall draft ratio ranging from about 1.01 to about 4 and a maximum draft ratio between sets of nip rolls of about 2. However, a very good product is produced utilizing from about three to five sets of nip rolls with an overall draft ratio ranging from about 1.2 to about 1.8 and a maximum draft ratio between sets of nip rolls of about 1.3.

The batt 56, thus drafted in the machine direction, is then passed from the nip rolls 52 via the outlet apron 54 to the needle loom 58 in which the batt is needle punched to render the fibers more coherent and thus produce a more coherent material. As previously noted, one or more needle looms can be used and, in addition, each needle loom can be a double-board needle loom. It should be noted that the batt will be subjected to some additional drafting in the machine direction as it passes through the needle loom which must be taken into consideration in determining the operating speeds of equipment positioned subsequent to the needle loom. It is not uncommon to experience such drafting at a ratio in the range of from about 1.3 to about 2, employing one single-board needle loom or one double-board needle loom. The larger drafting ratios in the above range are normally experienced when using a double-board needle loom.

The thus drafted and needle punched batt 60 is again drafted in the machine direction in the second drafting means 62 which employs nip rolls 64 and 66, and operating the speed of the nip roll 66 at a slightly higher speed than the nip rolls 64. The draft ratio employed in the second drafting means or drafting zone is also selected depending upon the material being processed. Generally the draft ratio in the second drafting means or zone 62 ranges from about 1.01 to about 2; however, a good product is produced utilizing a draft ratio ranging from about 1.3 to about 1.5.

The needled batt 68, which has been drafted in the machine direction both before and after being needle punched in the needle loom 58, is then passed to a transverse drafting zone, indicated by the tenter frame 72, which drafts the batt in the transverse direction through use of the diverging tracks 73 which grasp the fabric at the inlet and draft the fabric as the tracks slowly diverge from one another in the machine direction. The transverse drafting ratio depends upon a number of variables, such as staple length, denier, batt weight, needle density, etc. Generally the transverse drafting ratio ranges from about 1.01 to about 1.5; however, a transverse drafting ratio ranging from about 1.1 to about 1.3 produces a good product. The tenter frame 72 also contains a tensioning zone 76 which applies transverse tension to the transversely drafted fabric web or batt 78 while the fabric is subjected to some form of fusion to fuse at least a portion of the staple fibers together on one side of the fabric and thereby form a fused face on the one side of the fabric. As disclosed herein, it is more advantageous to use the heater 80 to facilitate takeup and further processing of the nonwoven fabric in accordance with the invention. As previously noted, a suitable means for achieving fusion of at least a portion of the fibers on one side of the fabric is by infrared radiation or by heated rolls. It is presently preferred to achieve fusion of at least a portion of the fibers on one side of the fabric by means of infrared radiation.

After the fabric passes the transverse tensioning zone 76 of the tenter frame 72, the fabric 84 is passed to a surge zone such as the "J" box 96 over a plurality of rolls and onto a takeup zone indicated by a takeup roll 110.

Figure 3:
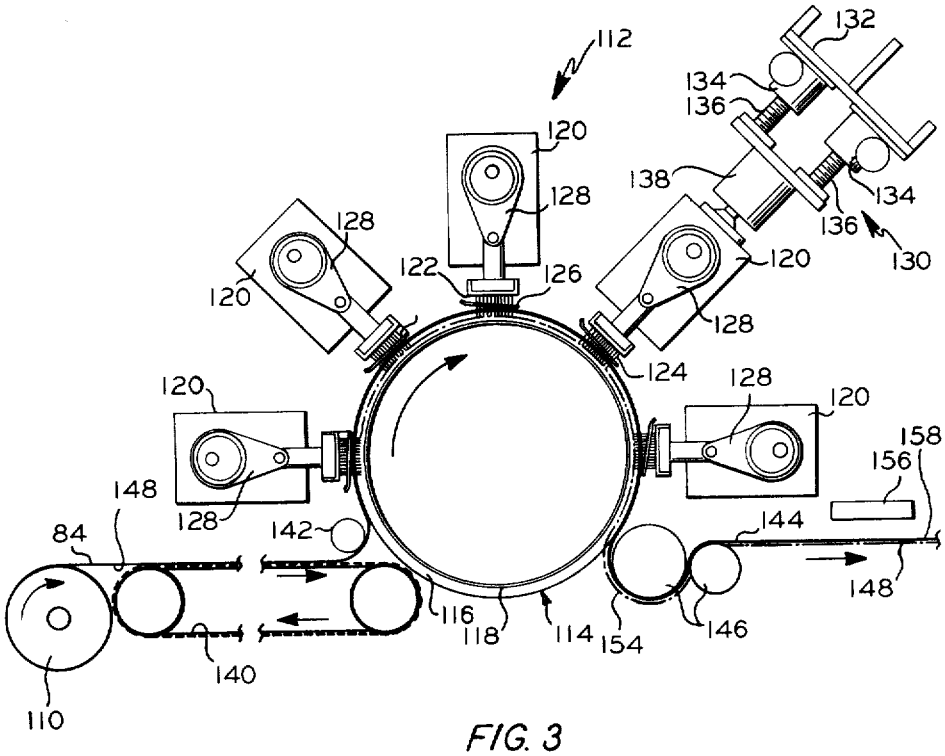
FIG. 3 is an elevation view of a schematic representation of additional apparatus employed in the production of the nonwoven fabric of the invention.

The thus drafted and needle punched nonwoven textile fabric batt or web 84, having a fused face on one side thereof, is subsequently fed from the takeup roll 110 to a second needle punching apparatus generally designated by the reference character 112, as best shown in FIG. 3. The apparatus 112 comprises a rotating elongated drum 114 having an axis extending perpendicularly to the plane of the drawing and defining a plurality of adjacent circumferential grooves between axially spaced annular blades 116 mounted along the entire length of a tube 118. Such a support drum in an apparatus for needling or needle punching nonwoven textile webs is described in U.S. Pat. No. 3,530,557, issued to Richard Dilo on Sept. 29, 1970, and is illustrated in a side view in FIG. 1 of that patent.

A plurality of needling or needle punching units 120 are angularly spaced at predetermined intervals about the circumference of the drum 114. In the illustrated embodiment, five needle punching units 120 are spaced about 45 degrees apart over one half the circumference of the drum 114. Each needle punching unit 120 comprises a needle beam 122 carrying a plurality of needles 124 and a stripper 126. The needles 124 are preferably forked needles, although barbed needles may be used under certain circumstances if desired. Needle punching is effected on the apparatus 112 by reciprocating the needle beams 122, a crank drive mechanism 128 being shown on each unit 120 to effectuate such reciprocation. The needle beams 122 and needles 124 are reciprocated in a radial direction in a plane perpendicular to the axis of the drum 114.

The radial distance of each needle punching unit 120 from the surface of the drum 114 can be adjusted by affixing the unit to an adjusting mechanism 130 (one shown) mounted on a frame 132 of the apparatus 112, the mechanism 130 comprising worm drives 134 adapted to radially displace threaded rods 136 connected to each unit 120. In this manner the punching depth of the needles 124 of each of the needle punching units 120 can be adjusted.

As shown, a reciprocating mechanism 138 (one shown) is mounted between each adjusting mechanism 130 and each corresponding unit 120. Thus, while the crank drive mechanism 128 of each unit 120 is continuously reciprocating the associated needle beam 122 and needles 124, selective reciprocation of each entire unit 120 by the corresponding reciprocating mechanism 138 at predetermined intervals can prevent the continuously reciprocating needles 124 from passing through the fabric web during such intervals.

The reciprocating mechanism 18 for each needle punching unit 120 preferably comprises a pressure fluid operated motor, e.g., a pneumatically or hydraulically actuated cylinder-and-piston device, the cylinder being mounted on a platform to which the threaded rods 136 are attached, while the piston rod is attached to the carrier of the respective crank drive mechanism 128. If desired, the reciprocating mechanisms 138 can be operated by a suitable programmed controller (not shown) or can be manually controlled.

As shown in FIG. 3, the needle punching apparatus 112 is provided with an endless conveyor mechanism 140 which receives the nonwoven textile fabric web 84 and feeds the web to the rotating drum 114 under a guide roller 142 thereby properly feeding the web 84 onto the drum surface. After the web 84 passes successively beneath the five needle punching units 120 in response to the rotation of the drum 114, the thus needle punched nonwoven textile fabric web or batt 144 is withdrawn from the surface of the rotating drum 114 by a pair of nip rollers 146. The fused face 148 of the batt or web 84 is on the one side of the batt or web contacting the circumferential surfaces of the annular blades 116 of the drum 114.

Figure 4:
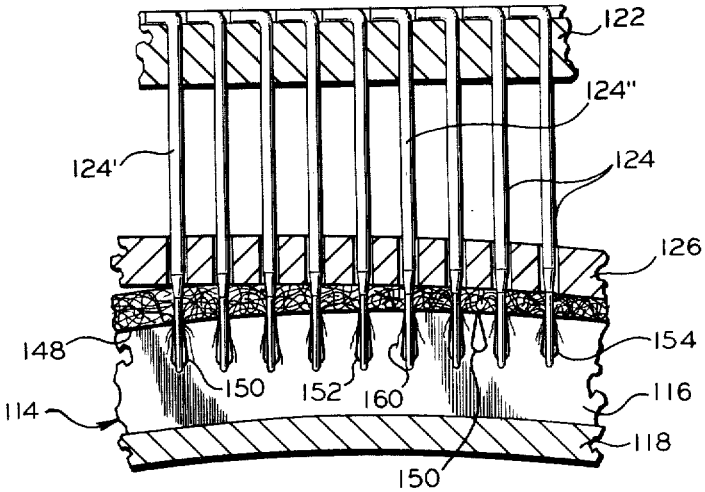
FIG. 4 is an enlarged cross-section view illustrating the needle punching operation of one of the needling units illustrated in FIG. 3.

As shown in FIG. 4, since all the needles 124 are of the same length, the arcuate shape of the drum support 114 causes the outermost needles 124' to penetrate less deeply into the drum grooves between the annular blades 116 to form shorter loops 150 while the central needles 124" penetrate more deeply into the drum grooves to form longer loops 152. Thus, the needle punching operation in the second needle punching apparatus 112 punches loops of different lengths, the shorter loops 150 supporting the longer loops 152 and thereby providing a filling effect. The resulting fabric presents a raised pile 154 extending outwardly from the fused face 148 of the web. Depending on the effect desired, the depth of penetration of the needles 124 can be increased to the extent that at least a portion of the fibers punched by the central needles 124" display free ends extending beyond the fused face 148, thus providing the appearance of fleece in the raised pile 154.

If desired, the needle punched batt 144 can be directed past a suitable heater 156, such as an infrared heater or a heated roll, in a second fusing zone to thereby fuse at least a portion of the fibers on the previously unfused opposite side of the batt 144 and form a second fused face 158 on the opposite side of the batt 144.

The apparatus 112 operates in the following manner. As the drum 114 is rotated counterclockwise, as viewed in FIG. 3, the nonwoven textile fabric batt or web 84 is delivered from the roll 110 to the drum 114, superposed thereon with the fused face 148 in contact with the drum 114. The batt or web 84 is needle punched by one or more of the needle punching units 120 during the continuous movement of the web 84 and drum 114, the thus needle punched web 144 being continuously removed from the drum by rotating the first one of the pairs of nip rollers 146 counterclockwise while the second one of the pair of nip rollers 146 is rotated counterclockwise. Suitable means for driving and controlling the apparatus 112 are disclosed in U.S. Pat. No. 3,909,891, issued to Richard Dilo and assigned to Oskar Dilo KG.

It will be understood that, if desired, the batt or web 84 can be delivered directly from the idler roll 108 to the endless conveyor mechanism 140 and drum 114 of the needle punching apparatus 112 without intermediate takeup of the web on a takeup roll. It will also be understood that the needle punched batt 144 can be suitably fed to an appropriate surge zone and takeup zone, such as those previously described and illustrated at 96 and 110, respectively.

Various normally solid polymeric thermoplastic staple fibers can be used in the invention. For example, polyolefins such as polypropylene, polyesters such as polyethylene terephthalate, polyamides such as polycaprolactum, acrylics and mixtures of any two or more thereof are suitable for use in the invention. Particularly good results have been obtained employing discontinuous or staple fibers of texturized polypropylene. It is also within the scope of the invention to use mixtures of natural and synthetic fibers.

The synthetic discontinuous or staple fibers suitable for use in the invention can be selected from staple fibers having a length in the range from about 1.5 inches (3.81 centimeter) to about 10 inches (25.4 centimeter). Good results have been obtained by employing a staple length in the range from about 2.5 inches (6.35 centimeter) to about 4 inches (10.16 centimeter). Staple denier can be selected from a wide range of suitable deniers. Normally the denier ranges from about 1 to about 20, however, deniers in the range from about 1.5 to about 8 are more common.

In accordance with the invention, the nonwoven textile batt or web is fused on the one side, as shown at 148, and optionally fused on the opposite side, as shown at 158, by subjecting the batt to infrared radiation. By using infrared radiation to fuse one or both sides of the nonwoven batt, the depth of fusion can be controlled and the integrity of the fiber crosssection can be maintained after fusion.

It is also within the scope of the invention to adhere by suitable means (not shown), a backcoating layer of latex or other suitable material to the side of the needle punched batt 144 opposite the raised pile 154. The back coating layer can be employed in lieu of the optional second fused face 158 or in addition thereto.

It is further within the scope of the invention to apply a layer of adhesive material, such as a contact adhesive, to the side of the batt 144 opposite the raised pile 154. The adhesive layer can be employed on the unfused face of the batt 144, on the optional second fused face 158 of the batt 144 or on the optional backcoating layer.

It should be further understood that it is within the scope of the invention to deliver the nonwoven textile fabric batt or web 84 to the drum 114 with the first face 148 facing away from the drum 114 and toward the needle punching units 120, if desired, although it is presently preferred to feed the web 84 to the drum 114 with the fused face 148 in contact with the drum, as described above.

Figure 5:
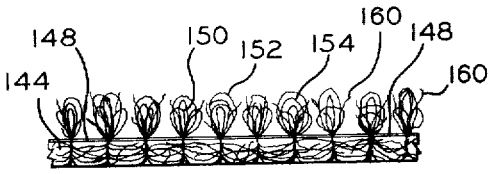
FIG. 5 is an enlarged cross-section of a nonwoven textile fabric constructed in accordance with the invention.

FIG. 5 illustrates, in enlarged cross-section, a nonwoven textile fabric 144 constructed in accordance with the invention. The fabric 144 is characterized by a first fused face 148 with a raised pile 154 extending outwardly from the fused face 148, the pile 154 comprising longer and shorter loops 152 and 150 as well as a plurality of free ends 160 of staple fibers.

Figure 6:
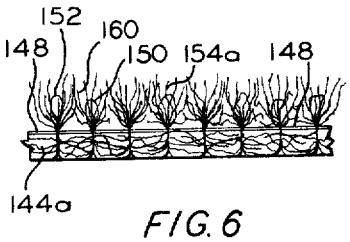
FIG. 6 is an enlarged cross-section of a nonwoven textile fabric constructed in accordance with the invention and similar to FIG. 5 showing a raised pile in the form of fleece.

FIG. 6 illustrates, in enlarged crosssection, a variant of the nonwoven textile fabric of the invention designated 144*a*. The fabric 144*a* is characterized by the first fused face 148 with a variant of the raised pile designated as 154*a*, which raised pile is further characterized by a predominance of the free ends 160 of staple fibers and highly stretched longer and shorter loops 152 and 150. The fabric presents a fleece-like appearance which can simulate the appearance of natural fleece and provide a both decorative and utilitarian textile product.

Figure 7:
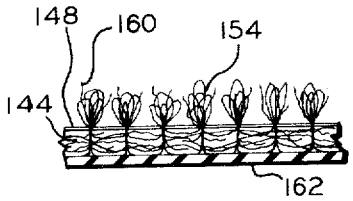
FIG. 7 is an enlarged cross-section of a nonwoven textile fabric in accordance with the invention showing a back coating on one side thereof.

FIG. 7 is similar to FIG. 5 and illustrates the nonwoven textile fabric 144 with a backcoating layer 162 adhered to the side of the fabric opposite the raised pile 154.

Figure 8:
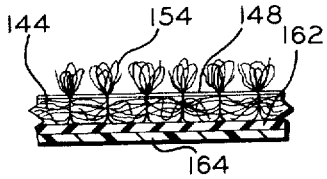
FIG. 8 is an enlarged cross-section of a nonwoven textile fabric similar to FIG. 6 illustrating an adhesive layer on the backcoating.

FIG. 8 is similar to FIG. 7 and illustrates the nonwoven textile fabric 144 with the backcoating layer 162 adhered to the side opposite the raised pile 154 and with a layer of adhesive material 164 on the backcoating layer 162.

Figure 9:
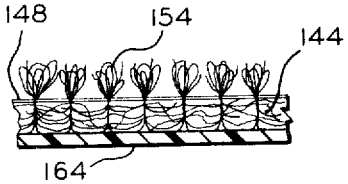
FIG. 9 is an enlarged cross-section of a nonwoven textile fabric similar to FIG. 7 illustrating an adhesive layer on one side of the fabric.

FIG. 9 is similar to FIG. 5 and illustrates the nonwoven textile fabric 144 with the layer of adhesive material 164 applied directly to the side of the fabric opposite the raised pile 154.

Figure 10:
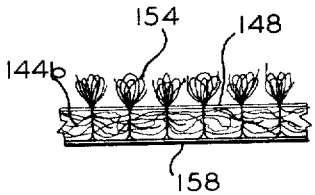
FIG. 10 is an enlarged cross-section of a nonwoven textile fabric in accordance with the invention wherein both sides of the batt are fused.

FIG. 10 illustrates, in enlarged cross-section, a variant of the nonwoven textile fabric of the invention designated 144*b*. The fabric 144*b* is characterized by a first fused face 148, a raised pile 154, and a second fused face 158 on the side of the fabric opposite the raised pile 154.

Figure 11:
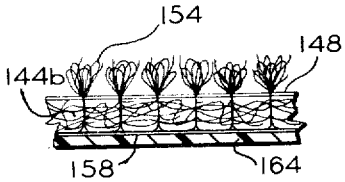
FIG. 11 is an enlarged cross-section of a nonwoven textile fabric similar to FIG. 10 with an adhesive layer on one side thereof.

FIG. 11 is similar to FIG. 10 and illustrates the nonwoven textile fabric 144*b* with a layer of adhesive material 164 on the second fused face 158 thereof.

Figure 12:
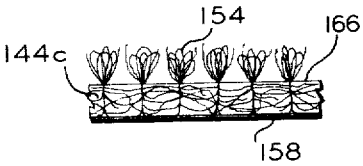
FIG. 12 is an enlarged cross-section of a nonwoven textile fabric in accordance with the invention wherein one side of the fabric opposite the raised pile is fused.

FIG. 12 illustrates, in enlarged cross-section, a variant of the nonwoven textile fabric of the invention designated 144*c*. The fabric 144*c* is characterized by a raised pile 154 extending outwardly from an unfused face 166 on one side of the fabric, and a fused face 158 on the side of the fabric opposite the raised pile 154 and unfused face 166.

Figure 13:
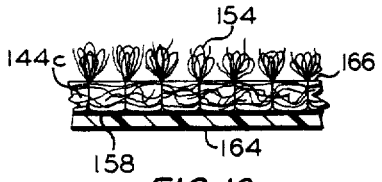
FIG. 13 is an enlarged cross-section of a nonwoven textile fabric similar to FIG. 12 with an adhesive layer on the fused side thereof.

FIG. 13 is similar to FIG. 12 and illustrates the nonwoven textile fabric 144*c* with a layer of adhesive material 164 on the fused face 158 thereof.

Figure 14:
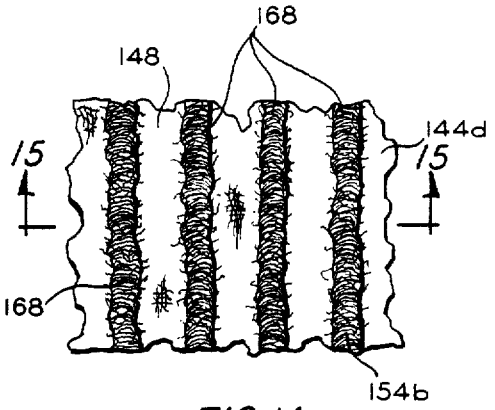
FIG. 14 is a top plan view of a nonwoven textile fabric in accordance with the invention illustrating a decorative pattern in the raised pile thereof.
Figure 16:
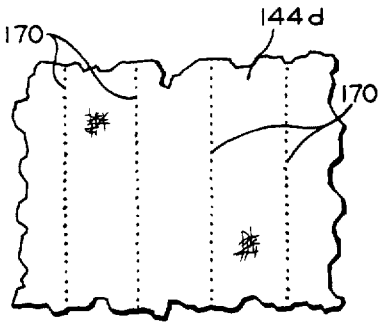
FIG. 16 is a bottom plan view of the nonwoven textile fabric of FIG. 14.
Figure 15:
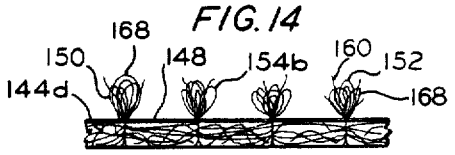
FIG. 15 is a cross-section of the nonwoven textile fabric of FIG. 14 taken along line 15—15.

FIGS. 14, 15 and 16 illustrate a nonwoven textile fabric 144*d* in accordance with the invention wherein the raised pile 154*b* is characterized by a plurality of spaced apart, mutually parallel rows 168 of longer and shorter loops 152 and 150 and free ends 160 of staple fibers extending through a first fused face 148. FIG. 16 illustrates the pattern of needle holes 170 in the side of the fabric 144*d* opposite the raised pile 154*b* which produces the decorative pattern illustrated in FIGS. 14 and 15.

Figure 17:
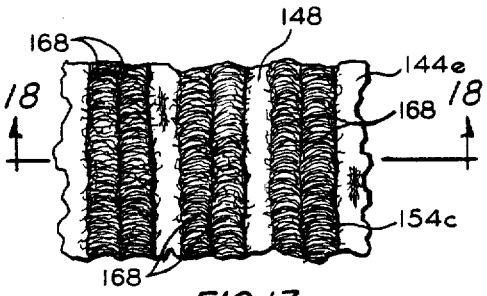
FIG. 17 is a top plan view of a nonwoven textile fabric in accordance with the invention illustrating another decorative design in the raised pile thereof.
Figure 19:
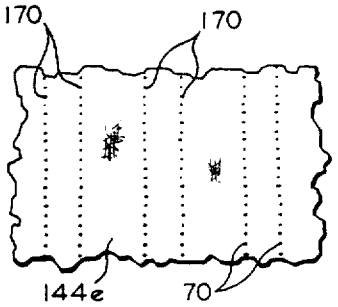
FIG. 19 is a bottom plan view of the nonwoven textile fabric of FIG. 17.
Figure 18:
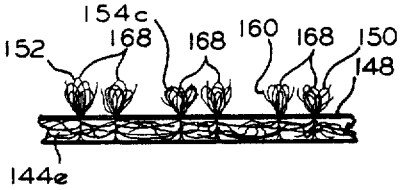
FIG. 18 is a cross-section taken along line 18—18 of FIG. 17.

FIGS. 17, 18 and 19 illustrate another nonwoven textile fabric 144*e*, similar to the fabric 144*d*, wherein a raised pile 154*c* is characterized by a plurality of spaced apart mutually parallel pairs of contiguous parallel rows 168 of longer and shorter loops 152 and 150 and free ends 160 of staple fibers extending through a first fused face 148. FIG. 19 illustrates the pattern of needle holes 170 in the side of the fabric 144*e* opposite the raised pile 154*c* which produces the decorative pattern illustrated in FIGS. 16 and 17.

Figure 20:
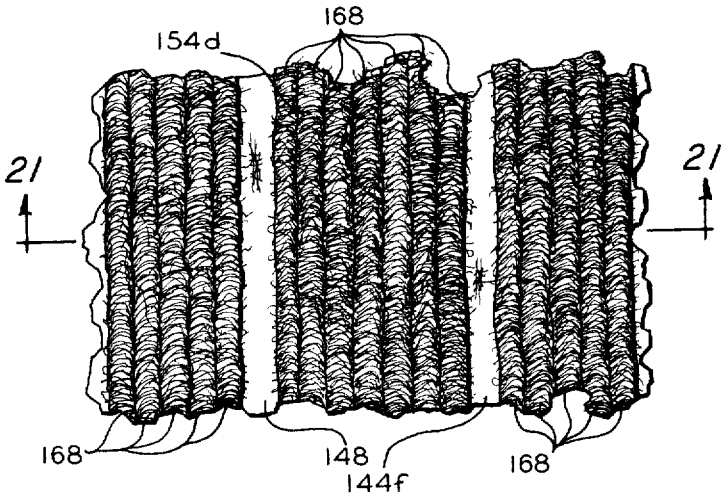
FIG. 20 is a top plan view of a nonwoven textile fabric in accordance with the invention illustrating another form of decorative pattern in the raised pile thereon.
Figure 21:
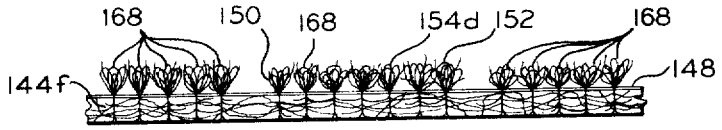
FIG. 21 is a cross-section taken along line 21—21 of FIG. 20.
Figure 22:
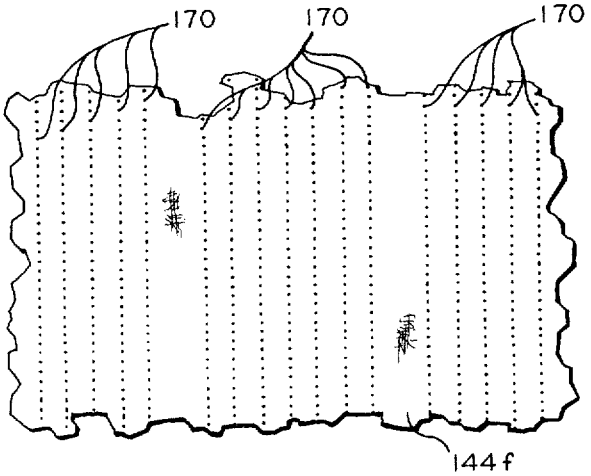
FIG. 22 is a bottom plan view of the nonwoven textile fabric of FIG. 20.

FIGS. 20, 21 and 22 illustrate yet another nonwoven textile fabric 144*f*, similar to the fabric 144*e*, wherein a raised pile 154*d* is characterized by a plurality of spaced apart mutually parallel sets of contiguous parallel rows 168 of longer and shorter loops 152 and 150 and free ends 160 of staple fibers extending through a first fused face 148. As specifically shown, the raised pile 154*d* consists of a repeating pattern of separated sets of five and seven contiguous parallel rows 168. FIG. 22 illustrates the pattern of needle holes 170 in the side of the fabric 144*f* opposite the raised pile 154*d* which produces the decorative pattern illustrated in FIGS. 20 and 21.

It will be readily seen that an infinite number of decorative patterns can be presented in the raised pile of the nonwoven textile fabric of the instant invention by varying needle patterns, varying needle punching depth, varying the needle density, varying the number of needle punching units employed, varying the needle configuration in the apparatus 112, etc. It will also be understood that fabric characteristics can also be readily altered by varying fabric weight, varying fiber denier, varying staple length, varying fiber texture, varying fiber material composition, combining fibers of differing compositions, combining fibers of differing colors, combining synthetic and natural fibers, etc.

Nonwoven textile fabrics produced in accordance with the invention can be employed in substantially the same manner as woven fabrics or natural material such as natural fleece. Among the useful applications of fabrics produced in accordance with the invention are linings for shoes, boots and clothing, upholstery, drapery material, wall coverings, carpeting, fleece collars and headwear, and similar articles.

Other reasonable variations or modifications are possible within the scope of the foregoing disclosure, the drawings and the appended claims to the invention.

That which is claimed is:

1. A textile fabric comprising:

a first side and a second side;

coherent nonwoven fibers;

a first fused face on said first side wherein at least a portion of the fibers on said first side are fused together; and a plurality of unfused fibers extending outwardly from said second side of said fabric whereby a raised pile is formed on said second side.

2. A textile fabric in accordance with claim 1 wherein said fibers comprise staple fibers.

3. A textile fabric in accordance with claim 1 wherein said fibers consist entirely of staple fibers.

4. A textile fabric comprising:

a first side and a second side;

coherent nonwoven fibers;

a first fused face on said first side wherein at least a portion of said nonwoven fibers on said first side are fused together;

a second fused face on said second side wherein at least a portion of said nonwoven fibers on said second side are fused together; and an unfused plurality of said nonwoven fibers extending outwardly from one of said sides of said fabric whereby a raised pile is formed on said one of said sides.

5. A textile fabric in accordance with claim 1 or claim 4 wherein said nonwoven fibers comprise normally solid thermoplastic polymeric staple fibers.

6. A textile fabric in accordance with claim 1 or claim 4 characterized further to include a backcoating layer adhered to the side of said fabric opposite said raised pile.

7. A textile fabric in accordance with claim 1 or claim 4 characterized further to include adhesive layer means on the side of said fabric opposite said raised pile for adhering said fabric to another surface.

8. A textile fabric in accordance with claim 7 wherein said raised pile defines a predetermined pattern on said fabric.

9. A textile fabric in accordance with claim 1 or claim 4 wherein said fabric displays a predetermined pattern thereon defined by at least one area of raised pile and at least one area having none of said raised pile.

10. A textile fabric comprising a batt of nonwoven filaments, said batt having a first side and a second side, said first side having a first fused face wherein at least a portion of said filaments on the first side are fused together and wherein a plurality of unfused filaments extend through said first fused face from between said second side and said first fused face to thereby form a raised pile on said first side extending outwardly from said first fused face, and said second side having a second fused face wherein at least a portion of said filaments on the second side are fused together.

11. A textile fabric in accordance with claim 10 wherein said filaments comprise discontinuous fibers.

12. A textile fabric in accordance with claim 11 wherein said discontinuous fibers comprise normally solid polymeric staple fibers.

13. A textile fabric in accordance with claim 12 wherein said polymeric staple fibers are thermoplastic.

14. A textile fabric in accordance with claim 12 wherein said polymeric staple fibers are formed of material selected from the group consisting of polyolefins, polyamides, polyesters, acrylics and mixtures of any two or more thereof.

15. A textile fabric in accordance with claim 14 wherein said filaments further include discontinuous natural fibers.

16. A textile fabric in accordance with claim 10 wherein at least a portion of said filaments are texturized filaments.

17. A textile fabric in accordance with claim 10 wherein said filaments consist of discontinuous polypropylene fibers.

18. A textile fabric in accordance with claim 17 wherein said discontinuous polypropylene fibers are texturized fibers.

19. A textile fabric in accordance with claim 10 characterized further to include a backcoating layer adhered to said second side.

20. A textile fabric in accordance with claim 19 characterized further to include an adhesive layer on said bckcoating layer.

21. A textile fabric in accordance with claim 10 wherein said first side displays a predetermined pattern thereon defined by at least one area of said raised pile and at least one area of said first fused face having none of said raised pile extending outwardly therefrom.

22. A textile fabric in accordance with claim 21 characterized further to include an adhesive layer on said second side.

23. A textile fabric in accordance with claim 22 wherein said adhesive layer is a contact adhesive layer.

24. A textile fabric in accordance with claim 10 characterized further to include an adhesive layer on said second side.

25. A textile fabric in accordance with claim 24 wherein said adhesive layer is a contact adhesive layer.

26. A method of producing a nonwoven fabric comprising the steps of:

forming a batt comprising nonwoven fibers;

drafting the thus formed batt in at least one direction;

fusing at least a portion of the fibers on one side of the thus drafted batt to form a fused face on the one side of said batt and an unfused face on the opposite side of said batt; and needle punching said thus fused batt so that at least a portion of the fibers from the unfused face are punched from the opposite side of said batt through the fused face to form a raised pile on the one side of said batt.

27. A method in accordance with claim 26 wherein said at least a portion of the fibers on one side of said thus drafted batt are fused by infrared radiation.

28. A method in accordance with claim 26 wherein said at least a portion of the fibers on one side of said thus drafted batt are fused by contacting a heated roll.

29. A method in accordance with claim 26 wherein said needle punching step is performed with a plurality of forked needles.

30. A method in accordance with claim 26 characterized further to include the additional step of:

fusing at least a portion of the fibers on said opposite side of said thus needle punched batt.

31. A method in accordance with claim 26 characterized further to include the additional step of:

fusing at least a portion of the fibers on said opposite side of said thus needle punched batt by infrared radiation.

32. A method in accordance with claim 26 characterized further to include the additional step of:

adhering a layer of backcoating material to the unfused face on the opposite side of said thus needle punched batt.

33. A method of producing a nonwoven fabric comprising the steps of:

forming a batt comprising staple fibers wherein said staple fibers are positioned primarily in a first direction;

drafting said batt in a first drafting zone in a second direction, said second direction being primarily perpendicular to said first direction;

needle punching said thus drafted batt in a first needle punching zone so as to render said fibers more coherent;

drafting said thus needle punched batt in a second drafting zone in said second direction;

drafting said thus drafted batt in a third drafting zone in said first direction;

fusing at least a portion of the fibers on one side of said thus drafted batt in a first fusing zone thereby forming a fused face on the one side of said batt and an unfused face on the opposite side of said batt; and needle punching said thus fused batt in a second needle punching zone whereby at least a portion of the fibers from the unfused face are punched from the opposite side of said batt through the fused face to form a raised pile on the one side of said batt.

34. A method in accordance with claim 33 characterized further to include the additional step of:

adhering a layer of backcoating material to the unfused face on the opposite side of said thus needle punched batt.

35. A method in accordance with claim 32 or claim 34 characterized further to include the additional step of:

applying a layer of adhesive material to the backcoating material on the opposite side of said batt.

36. A method in accordance with claim 33 wherein said at least a portion of the fibers on one side of said thus drafted batt are fused by infrared radiation in said first fusing zone.

37. A method in accordance with claim 33 wherein said at least a portion of the fibers on one side of said thus drafted batt are fused by contacting a heated roll in said first fusing zone.

38. A method in accordance with claim 33 wherein said needle punching step in said second needle punching zone is performed with a plurality of forked needles.

39. A method in accordance with claim 33 characterized further to include the additional step of:

fusing at least a portion of the fibers on the opposite side of said thus needle punched batt in a second fusing zone.

40. A method in accordance with claim 39 wherein said at least a portion of the fibers on the opposite side of said thus needle punched batt are fused by infrared radiation in said second fusing zone.

41. A method in accordance with claim 40 wherein said at least a portion of the fibers on the one side of said thus drafted batt are fused by infrared radiation in said first fusing zone.

42. A method in accordance with claim 40 wherein said at least a portion of the fibers on the one side of said thus drafted batt are fused by contacting a heated roll in said first fusing zone.

43. A method in accordance with claim 30 or claim 39 characterized further to include the additional step of:

applying a layer of adhesive material to the opposite side of said batt.

44. A method in accordance with claim 26 or claim 33 characterized further to include the additional step of:

applying a layer of adhesive material to the unfused face on the opposite side of said batt.

45. A method in accordance with claim 26 or claim 33 characterized further to include the additional step of:

applying a layer of contact adhesive material to the unfused face on the opposite side of said batt.

46. A method of producing a nonwoven fabric comprising the steps of:

forming a batt comprising nonwoven fibers;

drafting the thus formed batt in at least one direction;

fusing at least a portion of the fibers on one side of the thus drafted batt to form a fused face on the one side of said batt and an unfused face on the opposite side of said batt; and needle punching said thus fused batt so that at least a portion of the fibers are punched from the one side of said batt through the unfused face to form a raised pile on the opposite side of said batt.

* * * * *